United States Patent [19]

Laurel

[11] 4,402,649

[45] Sep. 6, 1983

[54] CEILING FAN WITH SELF-CONTAINED LIGHTING

[76] Inventor: Charles R. Laurel, 4482 Windjammer La., Fort Myers, Fla. 33901

[21] Appl. No.: 288,048

[22] Filed: Jul. 29, 1981

[51] Int. Cl.[3] ..... F04D 29/64

[52] U.S. Cl. ..... 416/5; 416/170 R

[58] Field of Search ..... 416/5, 170 R

[56] References Cited

U.S. PATENT DOCUMENTS

| | | | |
|---|---|---|---|
| 636,871 | 11/1899 | Wait | 416/5 |
| 2,547,896 | 4/1951 | Wellen | 416/5 |
| 2,581,185 | 1/1952 | Gordon | 416/5 |
| 3,039,678 | 6/1962 | Sharpe | 416/5 |
| 3,294,977 | 12/1966 | Duncan | 416/5 X |
| 4,064,427 | 12/1977 | Hansen et al. | 416/5 X |
| 4,073,598 | 2/1978 | Mizutani et al. | 416/170 R X |

FOREIGN PATENT DOCUMENTS

| | | | |
|---|---|---|---|
| 1011476 | 6/1952 | France | 416/5 |
| 751771 | 7/1956 | United Kingdom | 416/5 |

*Primary Examiner*—Everette A. Powell, Jr.
*Attorney, Agent, or Firm*—Alfred E. Wilson

[57] ABSTRACT

A ceiling fan is disclosed which is suspended from the ceiling in a conventional manner, and includes a plurality of fan blades secured to a rotatably driven outer portion of the motor assembly. The motor assembly is surrounded by a housing including top and bottom plates in a clamped engagement with an annular translucent panel, disposed peripherally between the plates, and including an annular fluorescent light bulb disposed within the housing in a surrounding relation to the motor assembly, including a support structure to hold the light bulb in a generally central position between the plates.

11 Claims, 5 Drawing Figures

CEILING FAN WITH SELF-CONTAINED LIGHTING

BACKGROUND OF THE PRESENT INVENTION

The present invention pertains to a ceiling fan provided with a self-contained lighting means to peripherally distribute light outwardly through an annular translucent panel and downwardly through the decorative scroll-work in a bottom panel of a housing, supported on a lower end portion of the main mounting tube of the fan assembly, and disposed about the fan motor assembly.

Therefore, one of the principal objects of the present invention is to provide a ceiling fan which includes a conventional annular fluorescent light bulb mounted within a housing, secured in an enclosing relation to the motor assembly of the ceiling fan. The light bulb is supported within an annular cavity defined between top and bottom plates of the housing, the periphery of the motor assembly, and an outer annular translucent panel, secured between peripheral edge portions of the top and bottom plates.

A further object of the invention is to provide means to removably position the annular light tube within the annular cavity.

Another object of the instant invention is to provide removable securing means to maintain the housing in place about the motor assembly.

DETAILED DESCRIPTION OF THE DRAWINGS

Figure 1:
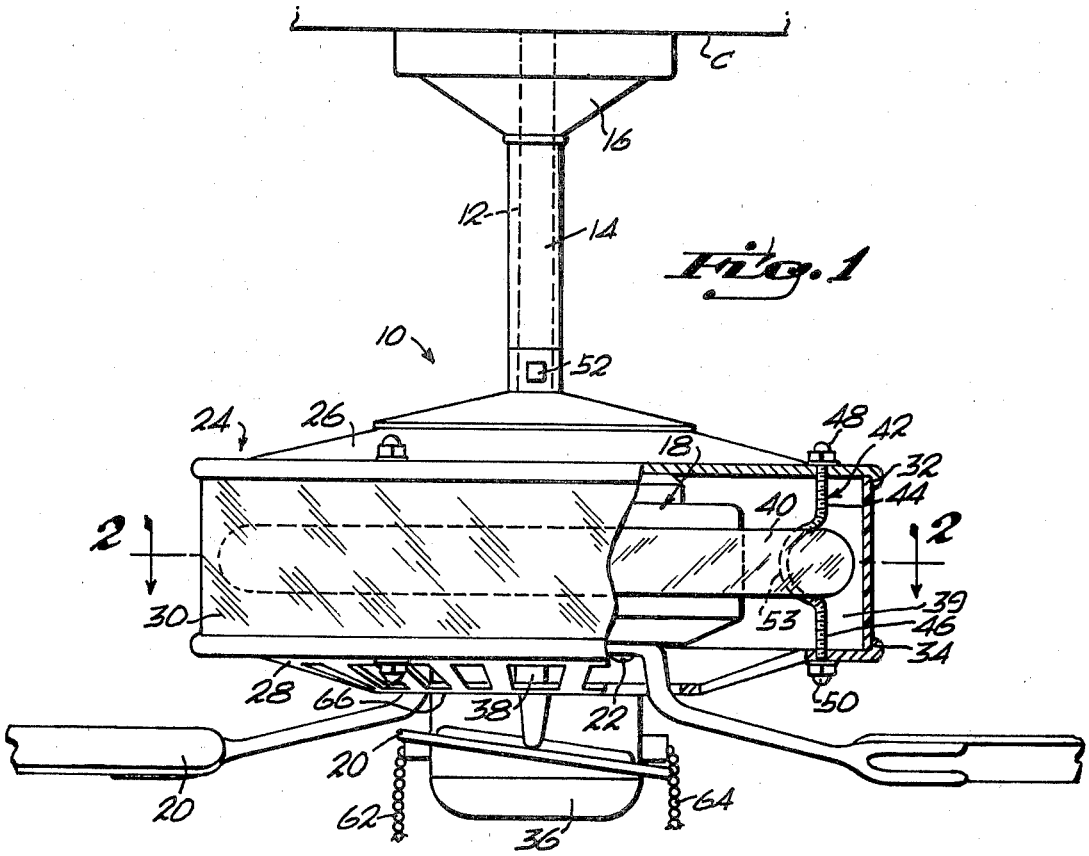
FIG. 1 is a side elevational view, partially in cross section, of the ceiling fan of the present invention.

With reference to the drawings, and particularly to FIG. 1, a ceiling fan, indicated generally at 10, includes a vertical mounting tube 12, mounted in a conventional manner relative to a ceiling C. A decorative tube 14 may be disposed about the mounting tube 12, along with a canopy 16 to cover the mounting elements, electrical junction box and ballast (not shown).

A motor assembly 18 is conventionally mounted to the bottom of tube 12 and a plurality of fan blades 20 are conventionally mounted at 22 to a rotatable member of the motor 18. The motor assembly 18 is disposed within a housing, generally indicated at 24, including a top cover plate 26, a lower cover plate 28 and an annular translucent panel 30. Cover plates 26 and 28 include confronting, peripheral annular lips 32, 34 which engage and secure the translucent panel 30 in place about the motor assembly 18. A control housing 36 is suspended at 38 below the bottom plate 28. The housing 24 defines an annular chamber portion 39 outwardly of the motor 18, which contours an annular fluorescent light tube 40.

Figure 2:
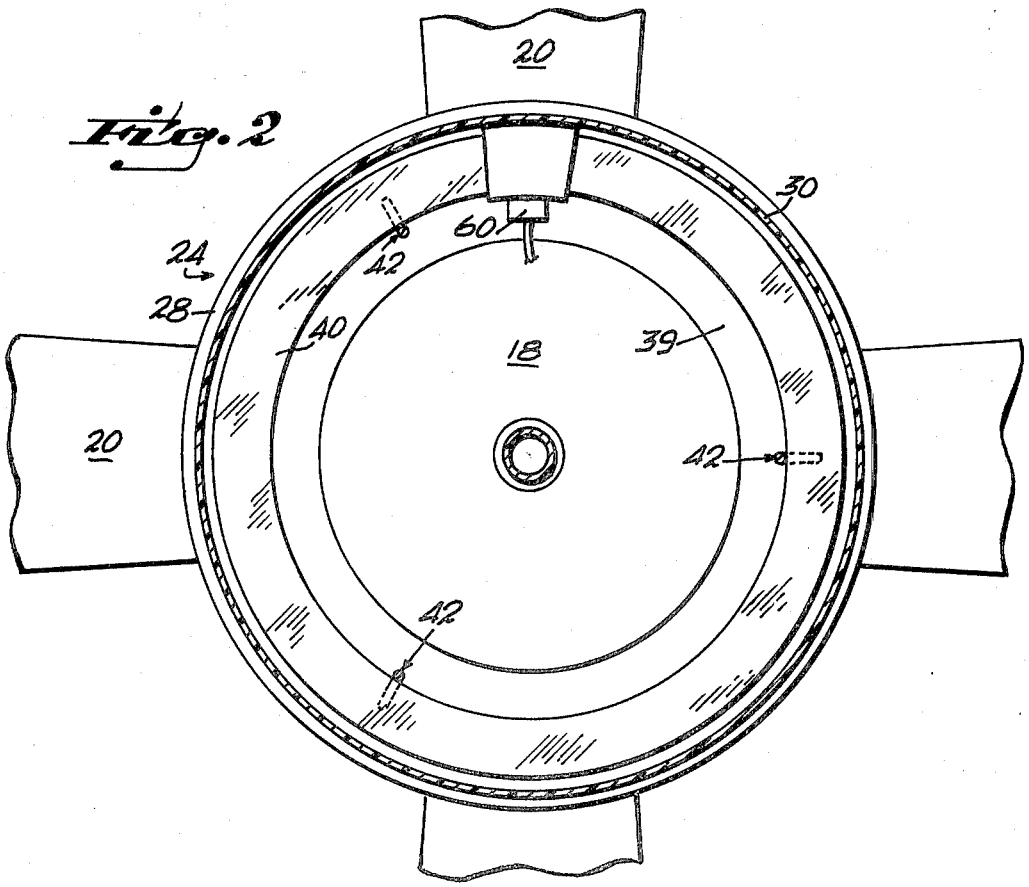
FIG. 2 is a cross sectional view taken along line 2—2 of FIG. 1.

In the form of the invention disclosed in FIGS. 1 and 2, a plurality of contoured threaded rods 42 span the chamber 39. Each rod 42 includes straight upper and lower portions 44, 46 which extend outwardly through the upper and lower cover plates 26 and 28 to receive nut means 48, 50 which secure the plates 26, 28 and the translucent panel 30 in assembly. A set screw 52 secures the housing assembly 24 to the mounting tube 12.

The central portion of each threaded rod 42 is semi-annularly configurated at 53 to embrace the surface of the light tube 40 through substantially 180 degrees. As best illustrated in FIG. 2, at least three contoured rods 42 are provided in an equally spaced relation. It is therefore seen that the three rods 42 maintain the housing 24 in assembly and secure the light tube 40 in a generally central position about the chamber 39.

An electric plug-in 60, FIG. 2, is provided to the annular fluorescent tube 40. The wiring, in general, is not illustrated, being conventionally directed downwardly through the mounting tube 12, from a junction box, to the control housing 36 for switch operation by respective chains 62, 64.

The bottom plate 28 includes a central clearance hole 66 for the control housing 36 and fan blades 20, and decorative open scroll-work to direct the light rays from tube 40 downwardly as well as radially outwardly through the translucent panel 30. In practice, the top cover plate 26 may match the decorative design of the bottom plate 28.

Figure 3:
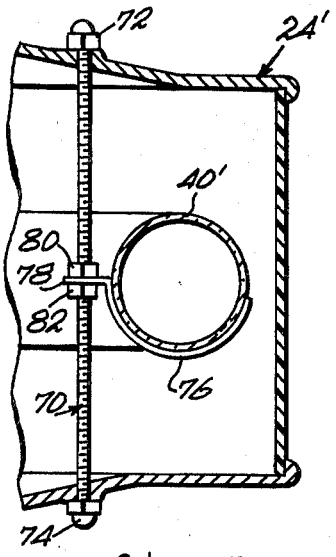
FIG. 3 is a fragmentary cross sectional view illustrating a first modified form of light bulb and housing securing means of the present invention.

FIG. 3 illustrates a first modification of the threaded rod 42 and is designated at 70. Rod 70 is straight and includes upper and lower projecting ends to receive nut means 72, 74. A semi-circular bracket 76 of somewhat less than 180 degrees includes an arm portion 78 with a through hole for through engagement by rod 70. Upper and lower nuts 80, 82 on rod 70 are adjustably engaged against opposed sides of arm 78 to properly position the light tube 40' in the housing 24'.

Figure 4:
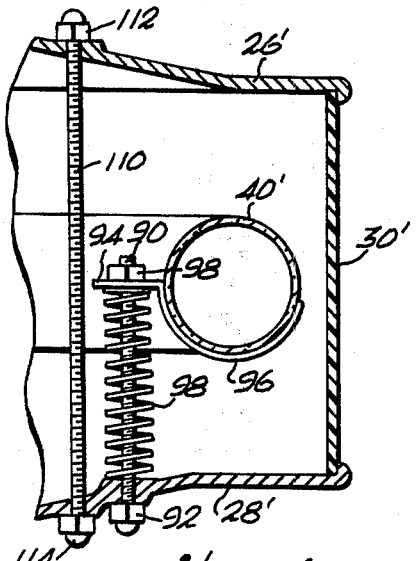
FIG. 4 is a similar cross sectional view illustrating a second modification thereof.

FIG. 4 illustrates a second modification in which a threaded rod 90 is engaged through the bottom plate 28' and secured by a lower nut 92, and extends upwardly through an arm 94 of a semi-circular bracket 96, of somewhat less than 180 degrees, which nests the bulb 40'. The bracket 96 is spring loaded as at 98, the spring being circumposed about rod 90 between the bottom plate 28' and an underside of arm 94. A nut 98' is threaded on the upper end of rod 90 against an upper face of arm 94.

Figure 5:
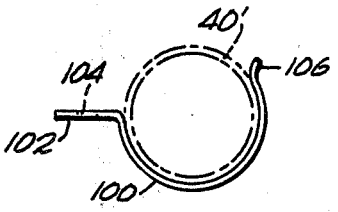
FIG. 5 illustrates a third modification for use with the forms of FIG. 3 and FIG. 4.

FIG. 5 illustrates a third modification comprising a semi-circular bracket 100 including an arm portion 102 with a through hole 104. Bracket 100 is somewhat in excess of 180° and includes an outwardly flared lip 106 to facilitate the snap-in engagement of a light tube 40'. Bracket 100 may be substituted for brackets 76 or 96 of FIGS. 3 and 4.

With further reference to FIG. 4, a separate threaded rod 110 is engaged through the top and bottom plates 26' and 28' with opposed outer end nuts 112, 114 to secure the plates 26', 28' and translucent panel 30' in assembly.

It will be understood that if desired the vertical mounting tube 12 may be shortened vertically almost to the vanishing point so long as a sufficient support is provided for the reception of the set screw 52 where it is desired to position the fan in rooms having relatively low ceilings. In this manner the fan can be positioned adjacent or close to be ceiling C to provide proper clearance for the blades 20 to rotate above the floor of the room in which it is mounted. Also if desired it will be apparent that if desired the top cover plate 26 can be reshaped to provide a substantially flat upper surface rather than the conical surface illustrated.

While several preferred forms of the present invention are herein disclosed, it will be evident to those skilled in the art that various changes and modifications can be made therein without departing from the true spirit of the invention as defined in the appended claims.

I claim:

1. A ceiling fan including a motor and control assembly, a plurality of fan blades in fixed attachment to a rotatably driven portion of the motor, and extending radially outwardly therefrom in a spaced relation, a generally vertical mounting tube having an upper end for mounting relative to a ceiling in a conventional manner, and a lower end carrying said motor assembly control assembly and fan blades, a housing disposed about said motor, defining an annular chamber portion outwardly of said motor, and including a lower plate providing a central opening to accommodate said fixed attachment, an upper plate, centrally fixed relative to a lower end portion of said mounting tube and being spaced a predetermined distance from said lower plate, a light transmitting panel disposed in a spanning relation between and about outer peripheries of said top and bottom plates, and means to support a conventional annular fluorescent light tube in said annular chamber, and means to secure said upper and lower plates, and light transmitting panel in assembly.

2. The ceiling fan as defined in claim 1 wherein said means to support and means to secure comprises a plurality of contoured threaded rods in predetermined spaced positions about and within said housing chamber portion, each rod including straight upper and lower end portions extending predetermined distances outwardly of said upper and lower plates for reception of respective nut means to secure said upper and lower plates and light transmitting panel in assembly, and a central semi-annular support portion, positioned and sized to embrace the surface of said light tube about approximately one-half of the vertical cross sectional circumference thereof.

3. The ceiling fan as defined in claim 1 wherein said means to support and secure comprises a plurality of generally straight threaded rods in predetermined spaced positions about and within said housing chamber portion, each rod including opposed end portions extending predetermined distances outwardly of said upper and lower plates for reception of respective nut means to secure said upper and lower plates and said light transmitting panel in assembly, and a semi-circular bracket, of a predetermined number of degrees, including a radially extending arm with a through hole for through engagement by said rod, and upper and lower nuts engaged on a mid-portion of said rod for adjustable engagement against opposed upper and lower faces of said arm.

4. The ceiling fan as defined in claim 1 wherein said means to support comprise a plurality of threaded rods, each rod including a lower end for engagement a predetermined distance through said bottom plate for reception of a securing nut means, a semi-circular bracket of a predetermined number of degrees, including an outwardly extending arm with a through hole for through engagement by an upper end portion of said rod, said arm being disposed between an upper end nut, engaged on said rod, and a coil spring circumposed about said rod between said bottom plate and a bottom face of said arm.

5. The ceiling fan as defined in claim 1 wherein said means to secure comprises a plurality of threaded rods in predetermined spaced positions about and within said housing chamber portion, each rod including opposed end portions extending predetermined distances outwardly of said upper and lower plates for reception of respective nut means to secure said upper and lower plates and said light transmitting panel in assembly.

6. The ceiling fan as defined in claim 1 wherein said light transmitting panel comprises a translucent panel, formed of a suitable plastic material.

7. The ceiling fan as defined in claim 3 wherein said predetermined number of degrees comprises a maximum of 180 degrees.

8. The ceiling fan as defined in claim 3 wherein said predetermined number of degrees comprises a minimum of 181 degrees.

9. The ceiling fan as defined in claim 8 wherein said semi-circular bracket includes an outwardly flared lip on a distal end thereof.

10. The ceiling fan as defined in claim 1 wherein the vertical mounting tube is shortened vertically to position the fan adjacent the ceiling.

11. The ceiling fan as defined in claim 10 wherein the top of the fan housing is substantially flat.

* * * * *